United States Patent [19]

Hirz

[11] Patent Number: 4,938,260

[45] Date of Patent: Jul. 3, 1990

[54] PNEUMATIC AERSOL CAN FILLING MACHINE

[75] Inventor: Donald J. Hirz, Willowick, Ohio

[73] Assignee: The Sherwin-Williams Company, Cleveland, Ohio

[21] Appl. No.: 234,320

[22] Filed: Aug. 19, 1988

[51] Int. Cl.[5] ..... B65B 3/04

[52] U.S. Cl. ..... 141/20; 141/3; 141/97; 141/140; 141/266; 141/278; 141/277

[58] Field of Search ..... 141/3, 20, 97, 140, 141/141, 263, 266, 275, 276, 277, 278, 94

[56] References Cited

U.S. PATENT DOCUMENTS

| | | | |
|---|---|---|---|
| 2,009,400 | 7/1935 | Hapgood | 141/278 X |
| 2,613,023 | 10/1952 | Reich | 141/20 X |
| 2,792,028 | 5/1957 | Henze et al. | 141/97 |
| 2,989,993 | 6/1961 | Osmond et al. | 141/20 |
| 3,181,575 | 5/1965 | Krizka | 141/141 |
| 3,211,191 | 10/1965 | Honisch | 141/20 |
| 3,489,186 | 1/1970 | Ricker | 141/141 |
| 3,589,410 | 6/1971 | Manas | 141/141 X |
| 3,604,477 | 9/1971 | Grothoff | 141/20 |
| 3,797,534 | 3/1974 | Skidmore | 141/3 |
| 4,538,659 | 9/1985 | Adelman et al. | 141/97 X |

FOREIGN PATENT DOCUMENTS

| | | | |
|---|---|---|---|
| 527971 | 4/1954 | Belgium | 141/277 |
| 527973 | 4/1954 | Belgium | 141/277 |
| 1256094 | 12/1967 | Fed. Rep. of Germany | 141/275 |
| 304001 | 1/1929 | United Kingdom | 141/276 |

OTHER PUBLICATIONS

"Omni-Fill New Mark II Pneumatic Filling System" Sherwin Williams Advertising Brochure.

"Omni-Fill New and Improved Mark III Pneumatic Filling System", Sherwin Williams Advertising Brochure 1986.

*Primary Examiner*—Ernest G. Cusick

*Attorney, Agent, or Firm*—Steven W. Tan; Robert E. McDonald; Jeanne E. Longmuir

[57] ABSTRACT

An aerosol can containing a liquid propellant is placed on a can support platform (44). An operator actuated fluid control switch (84) provides pneumatic fluid or compressed air to a pneumatic cylinder (46) which continuously biases the aerosol can upward into engagement with a reservoir outlet (66) of a liquid reservoir (60). A sensing switch (52) senses movement of the can support, hence, the aerosol can. An operator actuated start valve (92) enables compressed air to be supplied cyclically (78*a*, 78*b*, 96) to a pump pneumatic cylinder (70). A pump (74) driven by the cylinder cycles a preselected number of times as counted by counter (90) to pump a preselected amount of liquid from the reservoir through the reservoir outlet and into the aerosol can. The sensing valve disables the pump in response to (i) failure to raise the can support, (ii) raising the can support beyond the normal position of interaction between the aerosol can and the reservoir outlet, and (iii) in response to the can support moving downward during filling. This prevents the pump from attempting to pump liquid (i) when the aerosol can is not raised, (ii) when the aerosol can or reservoir is absent, and (iii) when a can becomes elongated due to overfilling. An aluminum cabinet (12, 14, 16, 28) is mounted to a caste base (10). Doors (30, 32) selectively provide access to an aerosol can receiving region (22) and a reservoir receiving region (24). An interlock valve (100) disables the pump and the can raising cylinders when the aerosol can access door is open.

10 Claims, 4 Drawing Sheets

PNEUMATIC AEROSOL CAN FILLING MACHINE

BACKGROUND OF THE INVENTION

The present invention relates to the art of filling pressurized containers. It finds particular application in conjunction with injecting paints and lacquers into aerosol cans which have been previously charged with fluid propellants and will be described with particular reference thereto. It is to be appreciated, however, that the present invention may also find application in conjunction with injecting other coating systems, lubricants, fragrances, cleaning agents, and other products commonly sold or dispensed from aerosol cans.

Heretofore, pneumatically operated machines have been available for injecting paint and the like into precharged aerosol cans. As illustrated in U.S. Pat. No. 3,797,534, such devices commonly included a manual lever for lifting an aerosol can to be charged into contact with a relatively small reservoir, e.g. one quart. A pneumatically operated piston drove the paint from a cylinder at the bottom of the reservoir through the aerosol valve into the can.

One of the drawbacks of the prior art machines was that the operator was poorly protected. A tubular frame, at best, has light weight panels attached to the frame. A see-through door which closed over the aerosol can being filled was susceptible to solvent attack. That is, spilled paints adhered to or permanently marred the see-through door rendering it's surface at least partially oblique.

Another disadvantage resided in the location of the operating components. Many of the pneumatic cylinders, control valves, and other moving components were not enclosed within a cabinet. Paint and solvent spilled on these components could damage the controls, by clogging or blocking movement, etching plastic or other solvent sensitive parts, and the like.

Another disadvantage of the prior art resided in the relatively small capacity of the paint reservoir. Moreover, paint within the open topped reservoir tended to lose solvent by evaporation and skin over. The multielement piston for pumping paint from the reservoir was difficult to position and adjust accurately when reinstalled after cleaning.

The mechanical aerosol can lifting mechanism added an element of potential operator error. If the lever were misadjusted such that the operator could urge the aerosol can against the reservoir too firmly, the aerosol can could be bent or damaged. Such overpressure or analogous underpressure between the can and the reservoir could cause leakage of the paint. During an attempted filling, the paint could spray under pressure over the base and other portions of the filling apparatus. The spilled paint could readily interact with the lever and lift mechanism causing binding and sticking.

The present invention provides a new and improved aerosol can filling apparatus which overcomes the above referenced operator safety and other drawbacks of the prior art.

SUMMARY OF THE INVENTION

In accordance with the present invention, there is provided an apparatus for charging pressurized aerosol cans. The apparatus includes a base in which an aerosol can support platform is movably mounted. A can support moving means selectively raises and lowers the can support platform at least between preselected raised and lowered positions. A liquid reservoir, which has an aerosol can engaging outlet, is mounted in a cabinet such that the reservoir outlet sealingly engages the aerosol can in the raised position. A pump means under the control of a pump control means selectively pumps a selected amount of liquid from the reservoir through the outlet into the aerosol can which is in a raised position.

In accordance with one aspect of the present invention, the can support moving means includes a pneumatic cylinder which selectively raises and lowers the can support platform and a can support control means for selectively controlling the pneumatic cylinder.

In accordance with a more limited aspect, a pressure limiting means is provided for limiting the pressure with which the pneumatic cylinder can urge the supported aerosol can into engagement with the reservoir outlet. The preselected pressure is selected to prevent deformation of the can.

In accordance with another aspect of the present invention, a sensing means is provided for sensing position of the can support platform. The sensing means interacts with the pump control means such that operation of the pump is prevented when the can support moves beyond the raised position. In this manner, operation of the pump is prevented (i) in the absence of an aerosol can, (ii) with the can in the lowered position, or (iii) in the absence of the reservoir.

In accordance with another aspect of the present invention, the sensor senses movement of the can support from the raised position toward the lower position during an accidental filling operation. The sensing means is connected with the pump control means to prevent pumping in response to the sensed downward movement. In this manner, elongation of the aerosol can due to overfilling disables the pump and prevents further filling of the can.

In accordance with another aspect of the present invention, the base includes an upward extending boss which is slidably received within a downward extending skirt on the can support platform. This sliding interaction between the skirt and the boss prevents spilled paint from getting into the raising and lowering mechanism and prevents the operator's fingers from being pinched between the can support platform and the base.

In accordance with another aspect of the invention, the pump control means and the control means for controlling raising of the can support are enclosed within the cabinet and mounted above the liquid reservoir. This prevents spilled and splashed liquids from damaging the control means.

In accordance with another aspect of the present invention, the cabinet includes doors which are selectively closable over the can support and reservoir regions of the apparatus. A safety interlock is connected with at least one of the doors for preventing the pump control means from causing the pump to pump liquids when the door is opened.

Other aspects of the present invention include a lid on the reservoir to reduce evaporation of liquids, the use of solvent resistant plastics in the doors, a single piece pump piston with an abutting shoulder coupling means to facilitate rapid and accurate interconnection of the pump with its driving cylinder, constructing the cabinet of anodized aluminum plates, and others described in greater detail below.

One advantage of the present invention is that it improves operator safety.

Another advantage of the present invention is that it renders the apparatus more immune to damage from spilled paints and other liquids.

Another advantage of the present invention is that it reduces damage to the filled aerosol cans.

Yet another advantage of the present invention is that it facilitates set up and operation of the filling machine.

Still further advantages of the present invention will become apparent upon reading and understanding the following detailed description of the preferred embodiments.

BRIEF DESCRIPTION OF THE DRAWINGS

The invention may take form in various parts and arrangements of parts. The drawings are only for purposes of illustrating a preferred embodiment and are not to be construed as limiting the invention.

DETAILED DESCRIPTION OF THE PREFERRED EMBODIMENT

Figure 1:
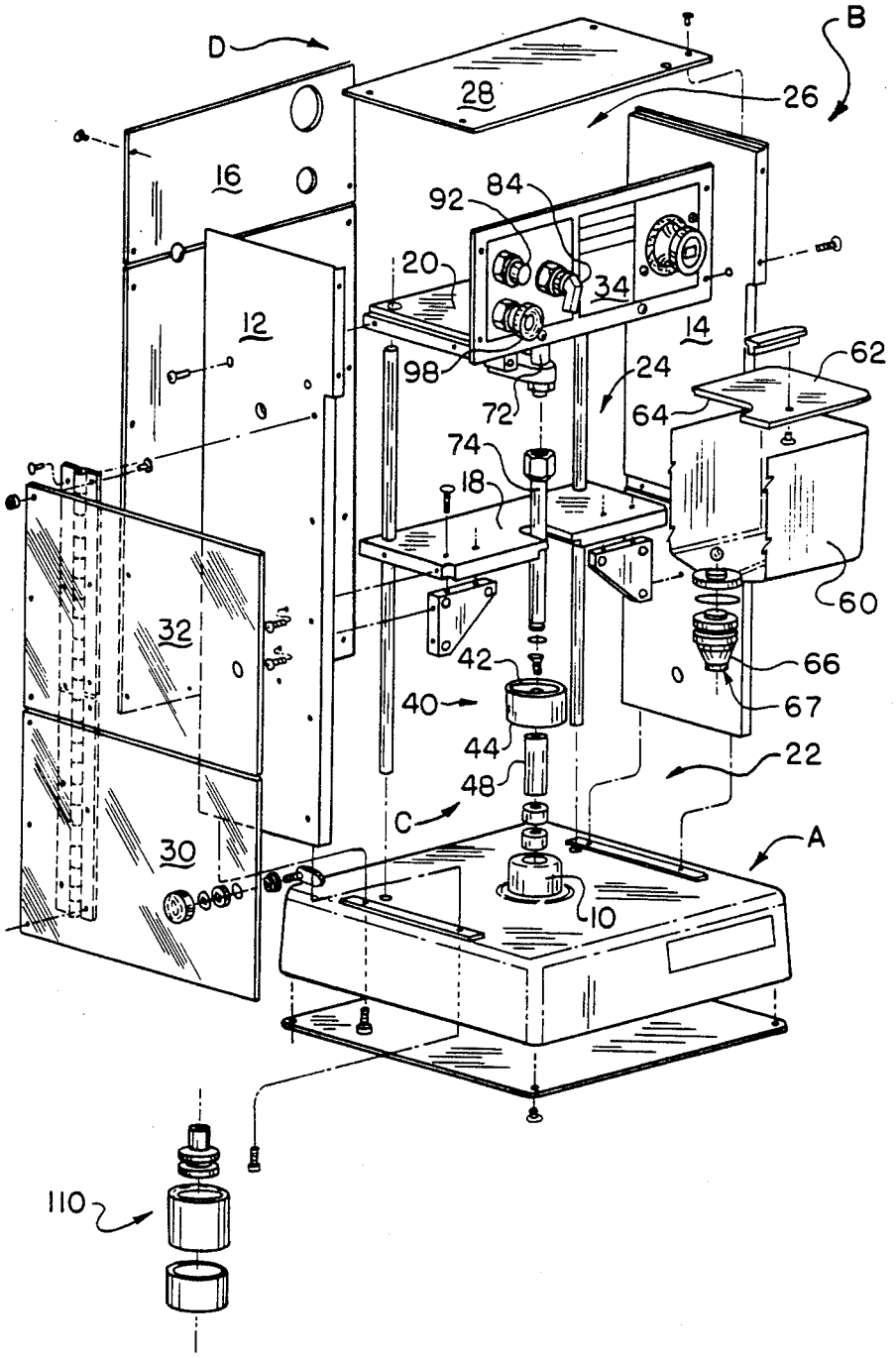
FIG. 1 is an exploded view in partial section of an aerosol can filling apparatus in accordance with the present invention.

With reference to FIG. 1, the apparatus for charging pressurized aerosol cans includes a base A on which a cabinet B is mounted. A can support assembly C supports an aerosol can being filled with paint or other liquid from a pumping assembly D.

The base A is a hollow, caste aluminum member which has a hollow interior. A boss 10 projects upward from the base directly below the can supporting assembly C. The cabinet B includes anodized aluminum side plates 12, 14 and a back plate 16. The cabinets plates, which have significant structural strength are mounted to, and extend upwardly from, the base and to each other with machine screws. A middle or reservoir support plate 18 and an upper support plate 20 divide the cabinet into an aerosol can receiving region 22, a reservoir region 24, and a control region 26. A top cover or plate 28, spaced from the base, is connected with the tops of the anodized aluminum side and back plates, which are mounted to and extend upwardly from the base, encloses the top of the control region 26. A pair of doors 30, 32 selectively close the aerosol can receiving region 22 and the reservoir receiving region 24, respectively. The doors 30, 32 are constructed of a solvent resistant material, such as translucent plastic, to enable the operator to observe the receiving regions 22, 24 during the filling operation. A control panel 34 closes the control region 26.

Figure 2:
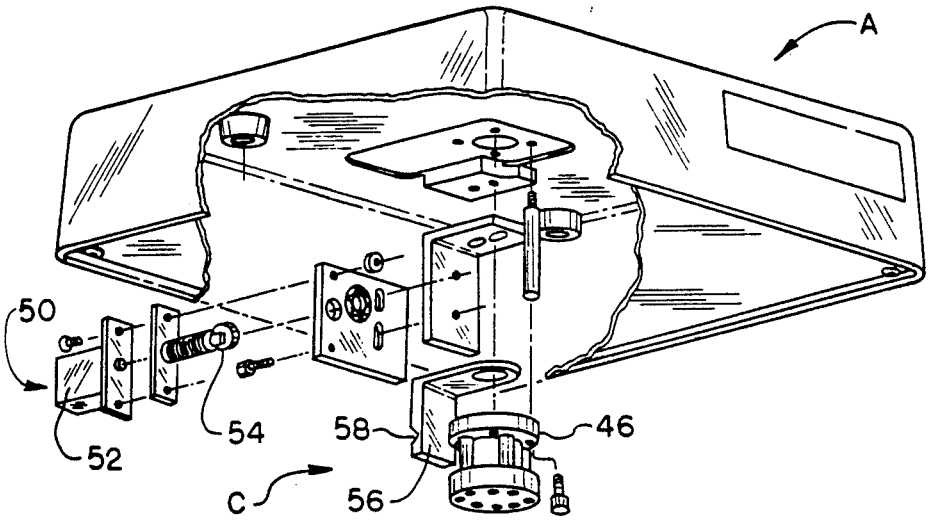
FIG. 2 is an exploded view illustrating the underside of the base.

With continuing reference to FIG. 1 and further reference to FIG. 2, the can supporting assembly C includes a can support platform 40 having a can supporting surface 42 and a downward extending skirt 44. The downward extending skirt 44 and the boss 10 are dimensioned relative to each other for close fitting coverage of the boss, whereby the boss 10 is slidably received within the skirt 44 for preventing spilled liquids from inhibiting operation of the raising and lowering mechanism, and preventing the operator's fingers from being pinched between the can support platform and the base. Moreover, the vertical extension of the skirt and boss are such that the skirt continues to overhang the boss even as the can support is lifted to a raised or filling position. The can support platform is selectively raised and lowered at least between a raised or can filling position and a lowered position in which cans are received and the filled cans are removed. The can support moving means includes a pneumatic cylinder 46 which is connected with the can support platform 40 by a platform shaft 48. A sensing means 50 includes a pneumatic valve 52 that is actuated by a roller 54 acting against can support control means comprising a cam 56 that moves with the can support platform 40. The roller engages a groove 58 in the cam when the platform is in the proper filling position. The cam moves out of the groove if the platform is raised beyond the raised or filling position or if the platform backs off from the raised position. Upon such movement of the cam out of the groove, the sensing means 50 is activated, and interacts with an interconnected pump control to prevent the pumping of liquid. Using the sensing means 50, the pumping of liquid is prevented when the can support platform 40 moves beyond the raised position, when the can support platform is raised without the sealing interaction of the can and the reservoir outlet, in the absense of an aerosol can or reservoir, or when the aerosol can is in the lowered position.

Additionally, the sensing means 50 senses downward movement of the can support platform 40 during the aerosol can filling operation. Upon downward movement of the can support platform, the pump control interconnected therewith, disables the pneumatic cylinder 70 of the pump assembly to prevent further filling of the can. The pump assembly is thus disabled, since downward platform movement may result from biasing of the aerosol can against the platform due to elongation of the can during the filling operation. During filling, a can can become elongated due to overfilling causing the valve 52 to change positions.

Figure 3:
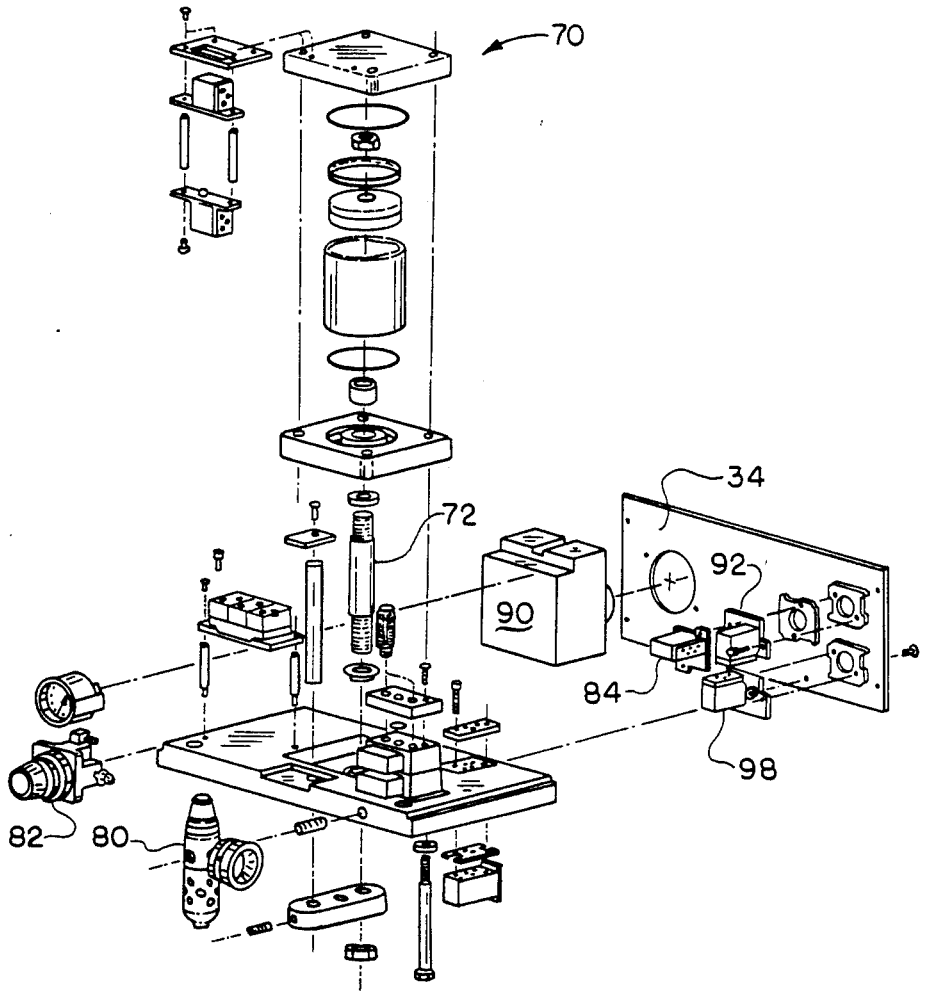
FIG. 3 is an exploded view of the pump and lift control apparatus.
Figure 4:
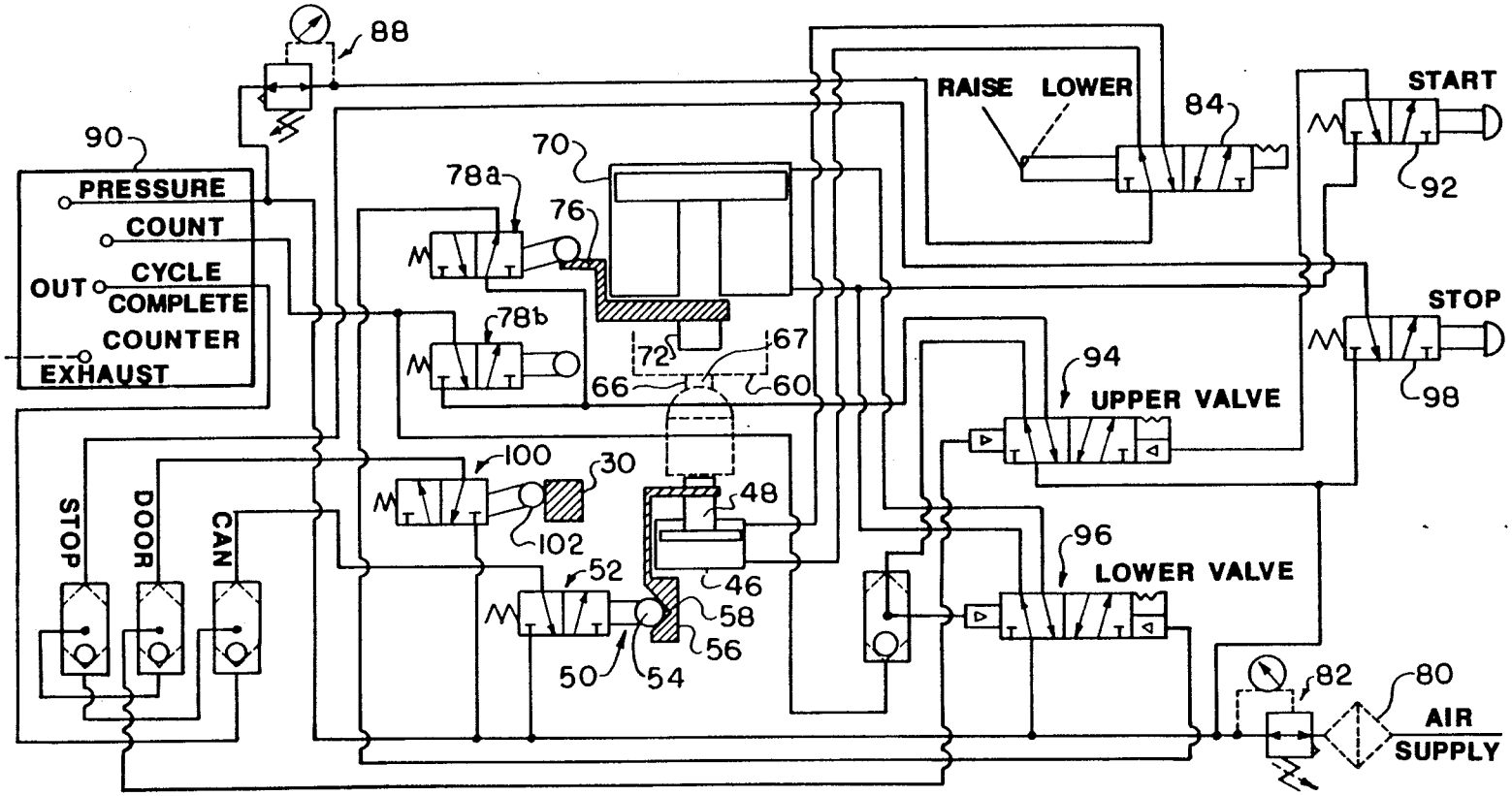
FIG. 4 is a diagrammatic illustration of the pneumatic circuitry of the apparatus of FIG. 1.

With reference to FIGS. 1, 3, and 4, the pumping assembly D includes a liquid reservoir 60, preferably a one gallon reservoir. The reservoir has an openable or removable lid 62 having a pump rod receiving aperture 64 therein for receiving a main piston pump rod 72. The removable lid 62 discourages evaporation of liquids from the reservoir. A pump chamber or cylinder 67 is defined within an outlet 66 of the reservoir. The reservoir outlet 66 and pump chamber 67 are located adjacent a lower portion of the reservoir 60 and configured to be engaged by the aerosol valve of the supported can with a firm, liquid-tight seal. Also, a pressure regulator 88 is provided in line with the pneumatic cylinder of the can support moving means 46 to limit the pressure between the outlet and the aerosol can to provide a firm, liquid-tight seal without damaging the aerosol cans.

The pump assembly further includes a pneumatic cylinder 70 that has the main piston pump rod 72 connected with a piston 74. The main piston rod and the piston have mating shoulders to define an abutting shoulder coupling for connecting the pump pneumatic cylinder 70 and pump piston 74, in order to provide, secure, positive positioning of the piston. A follower 76 engages pneumatic limit valves **78*a* and 78*b*** to signal each half cycle of the pump.

Compressed air or other pneumatic fluid is received by a filter 80 which removes any dust and other contaminants. A pressure regulator 82 regulates the compressed air to a preselected pneumatic pressure. A control valve 84 of the can support moving means selectively supplies compressed air with regulated pressure to the pneumatic cylinder of the can support moving means 46. In the fill position, the cylinder 46 continues to receive the pneumatic fluid such that it continually biases the can into contact with the reservoir outlet 66. If the pneumatic pressure set by the regulator 82 causes the pneumatic cylinder 46 of the can support moving means to bias the platform upward too strongly, another pressure regulator 88 may be provided in series with the pneumatic cylinder 46.

The pump control means includes a stroke counter 90 which supplies compressed air to the pneumatic pump cylinder 70. The stroke counter can be set by the operator for a selected number of pumping or piston strokes as counted by the limit valve 78*b*. A button actuated start valve 92 is pressed by the operator to initiate a pumping cycle. Momentarily pressing the start button 92 changes the state of the upper valve 94 from an off position to an on position which starts a valve 96 cycling pneumatic fluid to the top and bottom of the pneumatic pump cylinder 70. Once cycling starts, limit valves 78*a* and 78*b* reverse the state of cycle valve 96 at the extremes of movement of the piston 74 of cylinder 70. If the operator desires to stop the pumping of liquid, a button actuated stop valve 98 may be actuated by the operator to disrupt the flow of pneumatic fluid. As with the filling position sensing valve 52 actuation of the stop valve 98 also disrupts the flow of pneumatic fluid to the cylinder 70 and terminates a pumping cycle. The stop valve 98 causes a biasing force to be applied to valve 94 that changes its state and prevents valve 96 from being cycled. The stop valve enables the operator to override the automatic counter valve 90 and stop the pumping cycle at an operator selected point or in an emergency situation.

Additionally, both the can support controls and the pump controls are enclosed within the cabinet B and mounted at least partially above the reservoir 60. By enclosing the can support and pump controls within the cabinet and in part above the reservoir, spilled and splashed liquids are thus prevented from damaging the controls.

An interlock means or valve 100 has a cam 102 that is engaged when door 30 is closed. When the door is ajar, the interlock valve biases valve 94 to prevent the start of cycling of the cylinder 70.

The automatic counter 90 is selectively adjustable such that the number of pumping strokes may be varied to fill each can with a selectable amount of the liquid from the reservoir 60. Different types of paints are injected into the aerosol cans in different proportions. Normally, about one and a third to one and a half times as much enamel is injected into the aerosol can as lacquers, acrylics, or vinyls. Analogously, different size cans may be placed upon the can support platform. Spacers 110 may be selectively inserted into the can support platform 40 to compensate for the difference in height and diameter of different aerosol can sizes.

The invention has been described with reference to the preferred embodiment. Obviously, modifications and alterations will occur to others upon reading and understanding the preceding specification. It is intended that the invention be construed as including all such alterations and modifications insofar as they come within the scope of the appended claims or the equivalents thereof.

Having thus described a preferred embodiment, the invention is now claimed to be:

1. An apparatus for charging a pressurized aerosol can, the charging apparatus comprising:

a base;

an aerosol can support mounted adjacent the base for receiving a base of the aerosol can;

a liquid reservoir having an aerosol can engaging outlet for selective sealing engagement with the aerosol can;

a can support moving means for raising and lowering the aerosol can support between raised and lowered positions, said moving means including a pneumatic cylinder for selectively raising and lowering the can support whereby the supported can is raised smoothly into sealing engagement with the reservoir outlet, and a can support control means for selectively controlling the pneumatic cylinder to move the can support between positions and continuously biasing the can support toward the reservoir outlet in the raised position;

a cabinet connected with the base for supporting and enclosing the liquid reservoir such that the outlet sealingly engages the aerosol can in the raised position, said cabinet including a lower door providing access to the can support, an upper door providing access to the reservoir, and an interlock means connected with at least one of the doors for preventing the pumping of fluid when the door is open;

a pump means for selectively pumping liquid from the reservoir through the outlet into an aerosol can in the raised position;

a pressure limiting means for limiting a pressure with which the pneumatic cylinder urges the supported aerosol can into engagement with the outlet, whereby deformation of the can is prevented;

a pump control means for controlling the pump means to pump a selected amount of liquid into the aerosol can; and sensing means for sensing movement of the can support, and operatively connected with the pump control means, to prevent the pumping of fluid upon movement of the can support out of position.

2. The apparatus as set forth in claim 1 wherein the can support moving means selectively moves the can support beyond the raised position in the absence of interaction between the aerosol can and the reservoir outlet; and, said sensing means for sensing movement of the can support being operatively connected with the pump control means to prevent the pumping of liquid upon movement of the can support beyond the raised position without interaction of the can with the reservoir outlet, or in the absence of an aerosol can or reservoir.

3. The apparatus as set forth in claim 2 wherein the sensing means further senses downward movement of the can support during filling and prevents the pumping of liquid in response thereto, whereby elongation of the can due to overfill disables the pumping of liquids.

4. The apparatus as set forth in claim 1 wherein said sensing means senses downward movement of the can support during filling, and the sensing means and operatively connected pump control means prevent the pumping of liquid in response to the sensed downward movement of the can support during filling, whereby elongation of the can due to overfilling disables the pumping of liquids.

5. The apparatus as set forth in claim 1 wherein:

the base includes an upward extending boss with an aperture therethrough;

a rod extends through the aperture and connects the pneumatic cylinder and the can support; and, the can support includes a downward extending skirt having an inner surface conforms generally to the boss for slidably receiving and engaging the boss therein, said skirt operable to block liquids spilled on the base from sticking and binding operation of said pneumatic cylinder, rod and can support moving means, and to block an operator's fingers from being pinched between the can support and the base.

6. The apparatus as set forth in claim 1 wherein the can support control means and the pump control means are enclosed within the cabinet and mounted at least in part above the liquid reservoir, whereby spilled and splashed liquids are prevented from damaging the control means.

7. The apparatus as set forth in claim 6 wherein the can support control means and the pump control means include operator actuated controls which are mounted higher than the liquid reservoir.

8. The apparatus as set forth in claim 1 wherein the reservoir includes a lid to inhibit liquids from evaporating therefrom.

9. The apparatus as set forth in claim 8 wherein the pumping means includes:

a pump pneumatic cylinder mounted within the cabinet and above the reservoir;

a single piece pump piston extending from the pump pneumatic cylinder;

an aperture defined in the reservoir lid;

a pump chamber defined by said outlet adjacent a lower portion of the reservoir, said pump piston extending from said pump pneumatic cylinder through said reservoir lid aperture and into the pump chamber; and, an abutting shoulder coupling means for connecting the pump pneumatic cylinder and pump piston to ensure positive positioning of the pump piston.

10. The apparatus as set forth in claim 1 wherein the cabinet further includes:

anodized aluminum side and back plates mounted to and extending upward from the base;

a top plate connected with the top of the side and back plates;

and wherein at least one of the doors is constructed of a solvent resistant translucent material.

* * * * *